US012747918B2

(12) United States Patent
Takeichi et al.

(10) Patent No.: US 12,747,918 B2
(45) Date of Patent: Sep. 29, 2026

(54) AIR CONDITIONER HAVING REFRIGERANT DISTRIBUTOR

(71) Applicant: SAMSUNG ELECTRONICS CO., LTD., Suwon-si (KR)

(72) Inventors: Hisashi Takeichi, Suwon-si (KR); Keiichi Tomita, Suwon-si (KR); Ryo Inoha, Suwon-si (KR); Hyunyoung Kim, Suwon-si (KR); Kazushige Tajima, Suwon-si (KR); Tadahiro Nakagawa, Suwon-si (KR); Tetsuya Ogasawara, Suwon-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 66 days.

(21) Appl. No.: 18/666,733

(22) Filed: May 16, 2024

(65) Prior Publication Data

US 2025/0314436 A1 Oct. 9, 2025

Related U.S. Application Data

(63) Continuation of application No. PCT/KR2022/014990, filed on Oct. 5, 2022.

(30) Foreign Application Priority Data

Nov. 30, 2021 (JP) ..... 2021-194201

(51) Int. Cl.
*F28F 9/02* (2006.01)

(52) U.S. Cl.
CPC ..... *F28F 9/0275* (2013.01); *F28F 9/0202* (2013.01)

(58) Field of Classification Search
CPC ..... F28F 9/02; F28F 9/0275; F28F 9/0202; F28F 9/22; F24F 1/0067; F24F 1/18; F25B 41/42; F25B 39/02; F28D 1/053
See application file for complete search history.

(56) References Cited

U.S. PATENT DOCUMENTS 7,571,761 B2 8/2009 Katoh et al.
8,371,366 B2 2/2013 Higashiyama et al.
(Continued)

FOREIGN PATENT DOCUMENTS

EP 3425320 A1 1/2019
JP 4069804 B2 1/2008
(Continued)

OTHER PUBLICATIONS

Pdf is translation of foreign reference JP-2017211113-A (Year: 2017).*

(Continued)

*Primary Examiner* — Len Tran
*Assistant Examiner* — Kamran Tavakoldavani
(74) *Attorney, Agent, or Firm* — CANTOR COLBURN LLP

(57) ABSTRACT

An air conditioner including an outdoor air heat exchanger and an indoor air heat exchanger is provided. At least one of the outdoor air heat exchanger and the indoor air heat exchanger includes a main tube, at least two distribution flow paths that are independent of each other, to which a plurality of branch tubes branched from the main tube are connected, a header cover divided into a plurality of partition spaces receiving the refrigerant from the at least two distribution flow paths, and a plurality of heat exchange tubes connected to the plurality of partition spaces. A distribution flow path among the at least two distribution flow paths is configured to supply the refrigerant to a predetermined number of partition spaces, and another distribution flow path among the at least two distribution flow paths is configured to supply the refrigerant to other partition spaces.

20 Claims, 14 Drawing Sheets

(56) References Cited

U.S. PATENT DOCUMENTS

| | | | | |
|---|---|---|---|---|
| 9,557,121 | B2 | 1/2017 | Park et al. | |
| 12,359,853 | B2 * | 7/2025 | Satou | F28F 9/0278 |
| 2006/0162918 | A1 | 7/2006 | Horiuchi et al. | |
| 2015/0101363 | A1 * | 4/2015 | Matsuda | F25B 39/04 165/174 |
| 2016/0298887 | A1 | 10/2016 | Alahyari et al. | |
| 2017/0234587 | A1 * | 8/2017 | Jindou | F28F 9/0204 62/527 |
| 2020/0072517 | A1 * | 3/2020 | Kato | F28F 9/262 |
| 2020/0363107 | A1 * | 11/2020 | Satou | F28F 9/22 |
| 2021/0018232 | A1 * | 1/2021 | Nagata | F25B 41/42 |
| 2022/0196255 | A1 | 6/2022 | Takeichi et al. | |

FOREIGN PATENT DOCUMENTS

| | | | | |
|---|---|---|---|---|
| JP | 4281634 | B2 | 3/2009 | |
| JP | 5087549 | B2 | 9/2012 | |
| JP | 5869517 | B2 | 1/2016 | |
| JP | 5901748 | B2 | 3/2016 | |
| JP | 2016180548 | A | 10/2016 | |
| JP | 6098451 | B2 | 3/2017 | |
| JP | 2017133820 | A | 8/2017 | |
| JP | 6202451 | B2 | 9/2017 | |
| JP | 6213362 | B2 | 9/2017 | |
| JP | 6239159 | B2 | 11/2017 | |
| JP | 2017211113 | A * | 11/2017 | |
| JP | 6583141 | B2 | 9/2019 | |
| JP | 2020001224 | A | 1/2020 | |
| JP | 6854971 | B2 | 3/2021 | |
| JP | 2021081076 | A * | 5/2021 | F25B 39/04 |
| JP | 2022099870 | A | 7/2022 | |
| KR | 20040012939 | A | 2/2004 | |
| KR | 20100067203 | A | 6/2010 | |
| WO | 2020217271 | A1 | 10/2020 | |

OTHER PUBLICATIONS

Pdf is translation of foreign reference JP-2021081076-A (Year: 2021).*

Pdf is translation of foreign refrerence JP-2017211113-A (Year: 2017).*

International Search Report corresponding to Application No. PCT/KR2022/014990; Dated Jan. 12, 2023; pp. 11.

Japanese Office Action corresponding to Application No. 2021-194201; Dated Dec. 24, 2024.

* cited by examiner (A)

(B)

AIR CONDITIONER HAVING REFRIGERANT DISTRIBUTOR

This application is a continuation application, claiming priority under § 365(c), of International Application No. PCT/KR2022/014990, filed on Oct. 5, 2022, which is based on and claims the benefit of Japanese Patent Application No. 2021-194201 filed on Nov. 30, 2021, the disclosures of which are incorporated by reference herein in their entireties.

TECHNICAL FIELD

The present disclosure relates to an air conditioner including a refrigerant distributor.

BACKGROUND ART

An air conditioner is a device that maintains indoor air in a desired condition and may include a compressor, heat exchangers (a condenser and an evaporator), an expansion valve, a blower, and components supportive of features of the air conditioner. A heat exchanger is a device that exchanges heat between a refrigerant flowing through a refrigerant pipe and outside or inside air. The heat exchanger may include a plurality of small-diameter tubes through which the refrigerant flows. When constructing a large outdoor unit using small-diameter tubes, pressure loss increases due to an increased length of the small-diameter tubes, so to solve this problem, some approaches increase the number of small-diameter tubes via multi-passing of the small-diameter tubes. Japanese Patent No. 6213362 discloses an evaporator using a plurality of small-diameter tubes, such as a porous flat tube (or microchannel), to improve performance of the evaporator.

Technical Solution

According to an aspect of the present disclosure, an air conditioner may include an outdoor air heat exchanger configured to perform heat exchange between outside air and a refrigerant, and an indoor air heat exchanger configured to perform heat exchange between inside air and the refrigerant. At least one of the outdoor air heat exchanger and the indoor air heat exchanger includes a main tube, at least two distribution flow paths that are independent of each other, to which a plurality of branch tubes branched from the main tube are connected, a header cover divided into a plurality of partition spaces receiving the refrigerant from the at least two distribution flow paths, and a plurality of heat exchange tubes connected to the plurality of partition spaces. A distribution flow path and another distribution flow path among the at least two distribution flow paths may be configured to supply the refrigerant to partition spaces in different regions among the plurality of partition spaces. For example, the distribution flow path among the at least two distribution flow paths may be configured to supply the refrigerant to a predetermined number of partition spaces among the plurality of partition spaces. Also, the other distribution flow path among the at least two distribution flow paths may be configured to supply the refrigerant to partition spaces at positions different from positions of the predetermined number of partition spaces among the plurality of partition spaces without supplying the refrigerant to the predetermined number of partition spaces.

DETAILED DESCRIPTION

Figure 1:
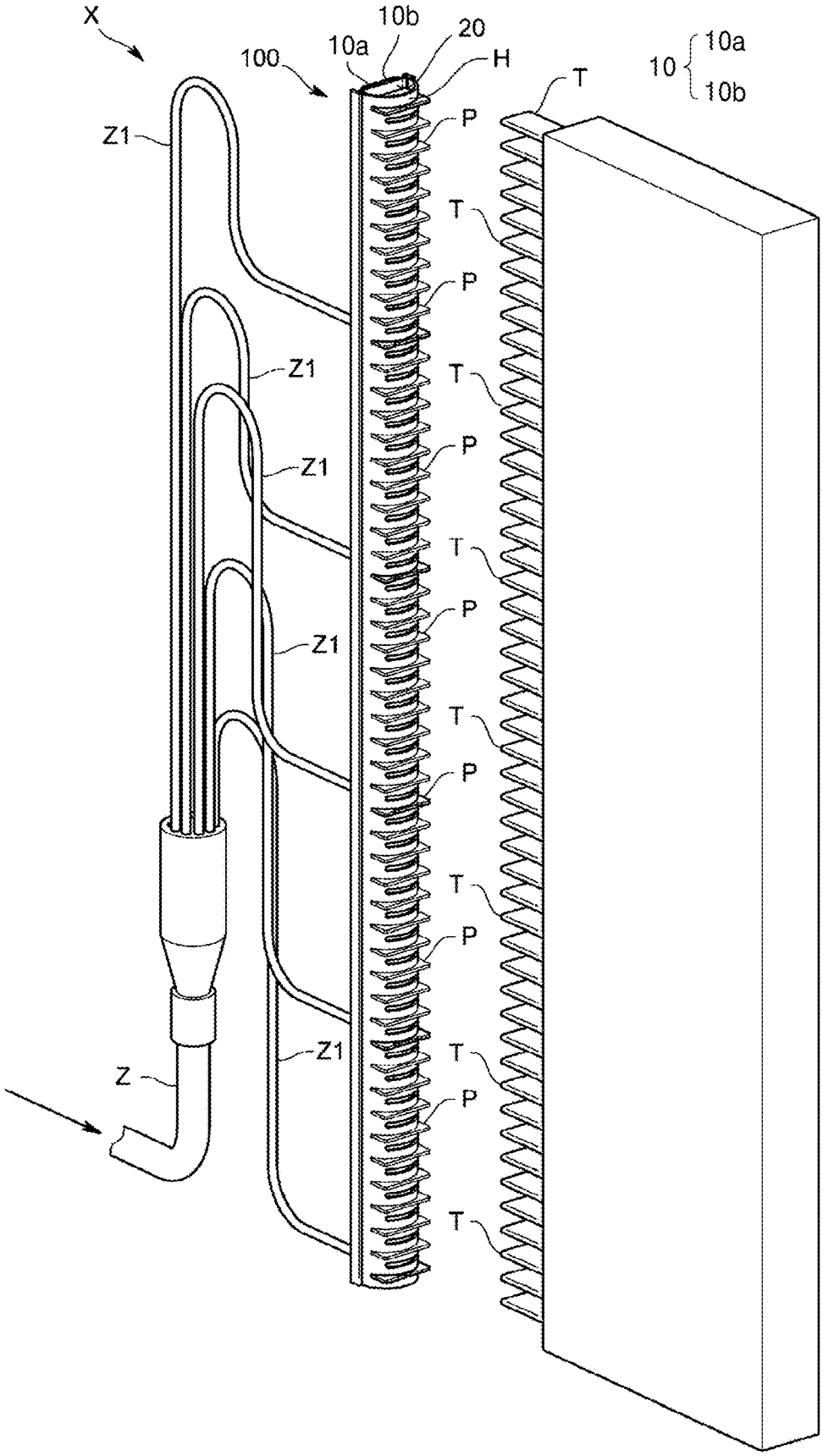
FIG. 1 is a schematic perspective view of a heat exchanger including a refrigerant distributor, according to an embodiment of the present disclosure.

As the terms used in the present specification, general terms that are currently widely used are selected by taking functions according to the present disclosure into account, but the terms may be changed according to the intention of one of ordinary skill in the art, precedent cases, advent of new technologies, or the like. Furthermore, specific terms may be arbitrarily selected by the applicant, and in this case, the meaning of the selected terms will be described in detail in the detailed description of a corresponding embodiment of the present disclosure. Thus, the terms used in the present disclosure are to be defined not by simple appellations thereof but based on the meaning of the terms together with the overall description of the present disclosure. Throughout the specification, when a part "includes" or "comprises" an element, unless there is a particular description contrary thereto, it is understood that the part may further include other elements, not excluding the other elements.

Embodiments of an air conditioner of the present disclosure will be described in detail below such that the embodiments may be easily implemented by one of ordinary skill in the art of the present disclosure. However, the present disclosure may be implemented in different forms and is not to be construed as being limited to embodiments set forth herein. In addition, parts not related to descriptions are omitted to clearly describe the present disclosure in the drawings, and like reference numerals denote like elements throughout.

In the case of a heat exchanger having a multi-pass small-diameter tubular structure, heat exchange performance may deteriorate because a refrigerant may be concentrated in some passes, and thus, it is important to distribute the refrigerant evenly among the passes. In addition, when the multi-pass small-diameter tubular structure is applied to a large upward blow-off outdoor unit, the size of the heat exchanger in a vertical direction may increase because a large number of small-diameter tubes are arranged in multi-stages in the vertical direction, resulting in an uneven wind speed distribution in the vertical direction. As a result, in an upper stage close to a fan, the wind speed may be high and heat exchange may be performed more efficiently due to the high wind speed, while in a lower stage respectively further from the fan, the wind speed may be low and all of the refrigerant supplied may not be used efficiently for heat exchange even if a large amount of refrigerant is supplied to the lower stage. Therefore, because the required amount of refrigerant to be supplied to each small-diameter tube may vary depending on the wind speed distribution, performing efficient heat exchange may depend on supplying an appropriate amount of refrigerant to each small-diameter tube.

The example embodiments supported by aspects of the present disclosure provide an air conditioner employing a refrigerant distributor capable of distributing a refrigerant supplied to each of a plurality of heat exchange tubes in appropriate amounts. For example, the example embodiments described herein may support effective distribution of refrigerant among the plurality of heat exchange tubes and prevent undesired concentration of refrigerant among some of the heat exchange tubes.

Figure 14:
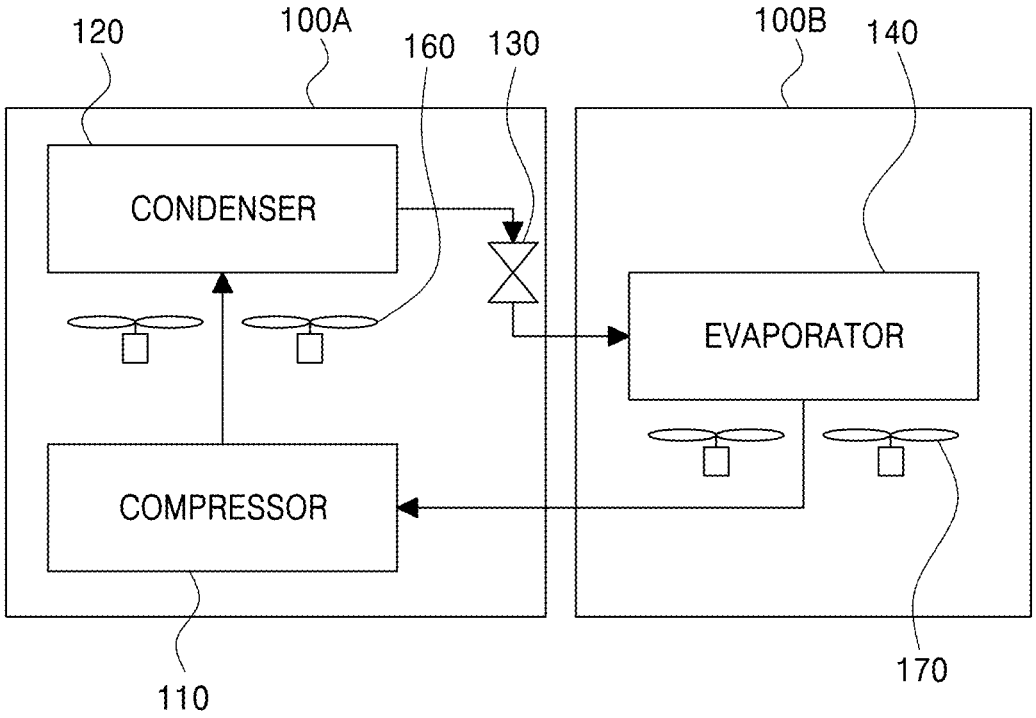
FIG. 14 is a schematic block diagram of an air conditioner according to an embodiment of the present disclosure.

FIG. 14 is a schematic block diagram of an air conditioner according to an embodiment of the present disclosure. Referring to FIG. 14, an air conditioner according to an embodiment of the present disclosure may include an outdoor unit 100A and an indoor unit 100B. The outdoor unit 100A may include a compressor 110, a condenser 120, and an expansion valve 130. The indoor unit 100B may include an evaporator 140. The compressor 110 compresses a low-pressure vapor refrigerant flowing from the evaporator 140 into a high-pressure vapor refrigerant. The condenser 120 condenses the vapor phase refrigerant from the compressor 110 into a liquid refrigerant via heat exchange with outside air. The condenser 120 is connected to the evaporator 140 via the expansion valve 130. When the liquid refrigerant passes through the expansion valve 130, the liquid refrigerant expands and is converted into a vapor-liquid mixed refrigerant. The vapor-liquid mixed refrigerant undergoes a phase change to a vapor refrigerant in the evaporator 140, and in this process, the temperature of indoor air is lowered by heat exchange between the indoor air and the refrigerant. Reference numeral 160 denotes a blower that supplies the outside air for heat exchange to the condenser 120. Reference numeral 170 denotes a blower that supplies the inside air (indoor air) for heat exchange to the evaporator 140. In the above description, the vapor refrigerant may partially include a liquid refrigerant, and the liquid refrigerant may partially include a vapor refrigerant.

The condenser 120 is an outdoor air heat exchanger that performs heat exchange between outdoor air and refrigerant. The evaporator 140 is an indoor air heat exchanger that performs heat exchange between indoor air and refrigerant. At least one of the outdoor air heat exchanger and the indoor air heat exchanger may be provided with a refrigerant distributor as described herein. Hereinafter, the indoor air heat exchanger and the outdoor air heat exchanger are collectively referred to as a heat exchanger, and a heat exchanger and a refrigerant distributor applied thereto according to embodiments are described. It is to be understood that descriptions in which a component "may be provided" with another component or is "formed to include" the other component refer to implementations in which the component "includes" or "comprises" the other component in accordance with example aspects described herein.

Figure 2:
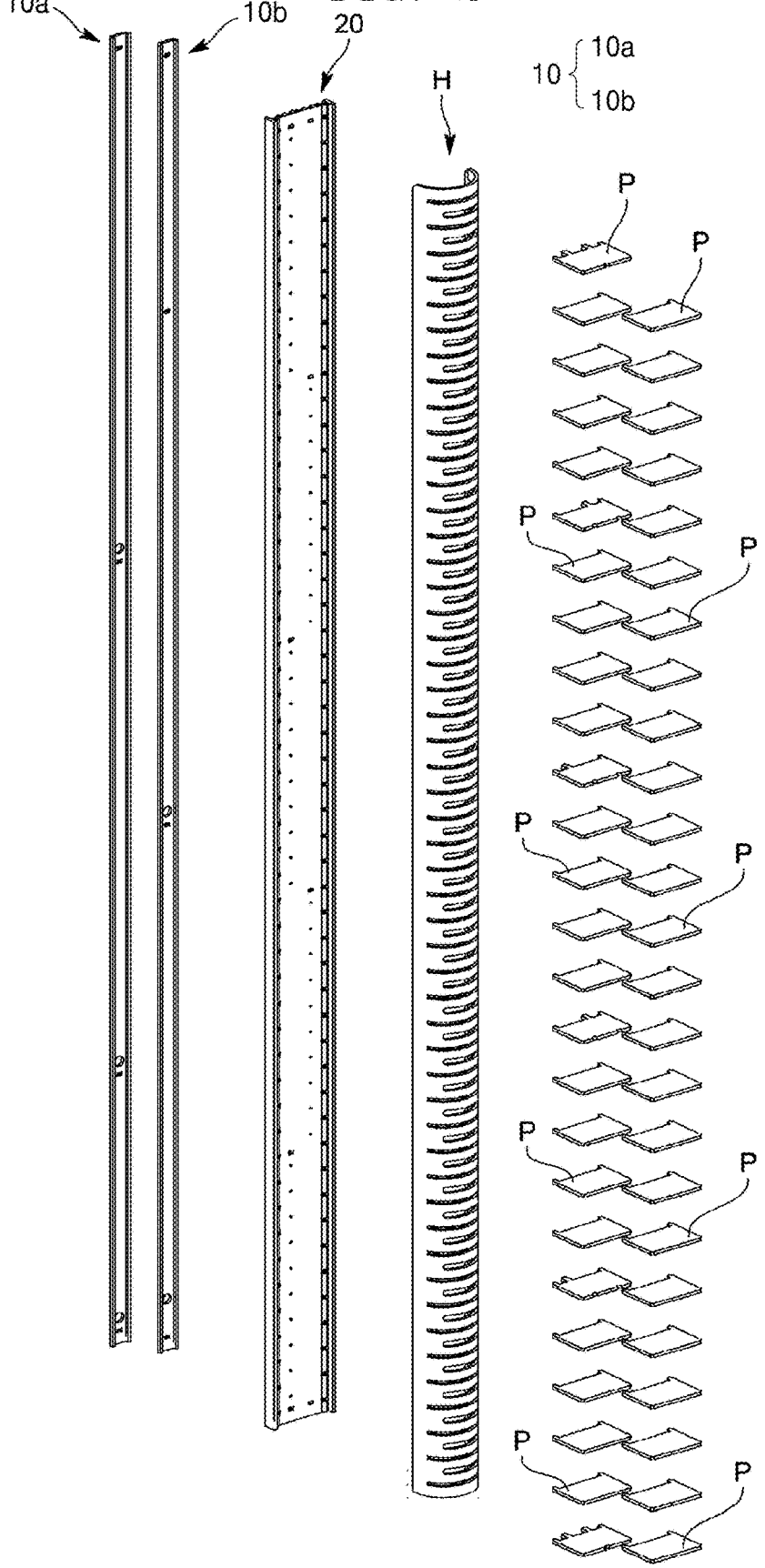
FIG. 2 is an exploded perspective view of a refrigerant distributor according to an embodiment of the present disclosure.

FIG. 1 is a schematic perspective view of a heat exchanger X including a refrigerant distributor according to an embodiment of the present disclosure. FIG. 2 is an exploded perspective view of the refrigerant distributor according to an embodiment of the present disclosure. Referring to FIGS. 1 and 2, a refrigerant distributor 100 according to an embodiment of the present disclosure may be used, for example, in a large upward blow-off outdoor unit (outdoor air heat exchanger). However, according to an alternative or additional embodiment of the present disclosure, the refrigerant distributor 100 may be used in a horizontal blow-off outdoor unit (outdoor air heat exchanger) or an indoor unit (indoor air heat exchanger).

The heat exchanger X may be provided with a plurality of small-diameter tubes T which are a plurality of heat exchanger tubes, and the heat exchanger X may be provided with the refrigerant distributor 100 that distributes a refrigerant flowing into the heat exchanger X to the plurality of small-diameter tubes T. The plurality of small-diameter tubes T may each be, for example, a porous flat tube (or microchannel). The plurality of small-diameter tubes T may be arranged side by side in multiple stages in the vertical direction.

The refrigerant distributor 100 distributes, to the plurality of small-diameter tubes T, the refrigerant supplied through a main tube Z provided on an upstream side of the heat exchanger X. A plurality of branch tubes Z1 branched from the main tube Z are connected to an upstream side of the refrigerant distributor 100, and the plurality of small-diameter tubes T are connected to a downstream side of the refrigerant distributor 100. The refrigerant distributor 100 may include a header cover H to which the small-diameter tubes T are connected, a flow path forming member 10 to which the branch tubes Z1 are connected, and an opening forming member 20 provided between the header cover H and the flow path forming member 10. The components according to embodiments are described below.

<Header Cover H>

Figure 3:
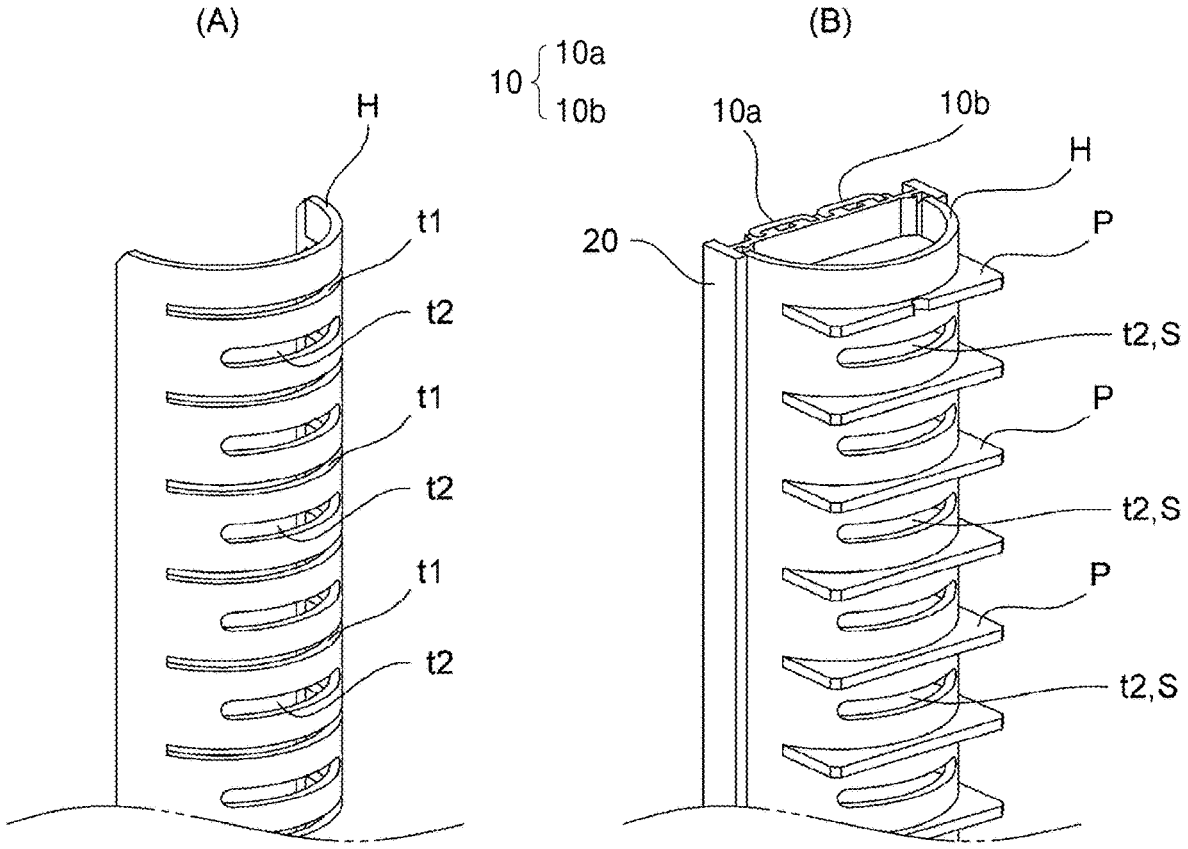
FIG. 3 is a schematic perspective view of a header cover according to an embodiment of the present disclosure.

FIG. 3 is a schematic perspective view of a header cover H according to an embodiment of the present disclosure. (A) of FIG. 3 is a perspective view of the header cover H, and (B) of FIG. 3 is a perspective view of the header cover H, the flow path forming member 10, and the opening forming member 20 combined together. Referring to FIG. 3, the header cover H may be divided into a plurality of partition spaces S to which a plurality of small-diameter tubes T are respectively connected by a plurality of partition plates P.

The header cover H extends in a direction (here, a vertical direction) in which the small-diameter tubes T are arranged, and have various cross-sectional shapes perpendicular to a longitudinal direction, such as, for example, a partially circular shape, a rectangular shape, a triangular shape, a polygonal shape, or one or more shapes supportive of embodiments of the present disclosure. According to an embodiment of the present disclosure, the header cover H may have a partially circular shape, for example, a semicircular shape. By making the cross-sectional shape of the header cover H partially circular, pressure resistance may be improved, and a thickness of a partially circular plate forming the header cover H may be reduced to achieve a lightweight design and lower costs.

As shown in (A) of FIG. 3, the header cover H is provided with a plurality of first slits t1 into which the partition plates P are respectively inserted, and a plurality of second slits t2 into which the small-diameter tubes T are respectively inserted. For example, the first slit t1 and the second slit t2 may each be formed to penetrate an outer circumferential surface of the header cover H. For example, each of the first slit t1 and the second slit t2 may penetrate the outer circumferential surface of the header cover H. In detail, the plurality of first slits t1 are formed in multiple stages, for example, at predetermined intervals along the longitudinal direction (here, the vertical direction) of the header cover H, and each of the second slits t2 is formed between the adjacent first slits t1. A spacing between each of the plurality of first slits t1 may be the same or partially different. For example, a spacing between a first pair of first slits t1 may be the same or partially different than a spacing between a second pair of first slits t1. A spacing between each of the plurality of second slits t2 may be the same or partially different. For example, a spacing between a first pair of second slits t1 may be the same or partially different than a spacing between a second pair of second slits t1.

As shown in (B) of FIG. 3, by mounting the header cover H to the opening forming member 20 as described herein and respectively inserting the partition plates P into the plurality of first slits t1, an interior of the header cover H, i.e., a space between the header cover H and the opening forming member 20, may be divided into the plurality of partition spaces S that are independent of one another. One or a plurality of small-diameter tubes T may be connected to each of the plurality of partition spaces S through the second slit t2.

<Flow Path Forming Member 10>

Figure 4:
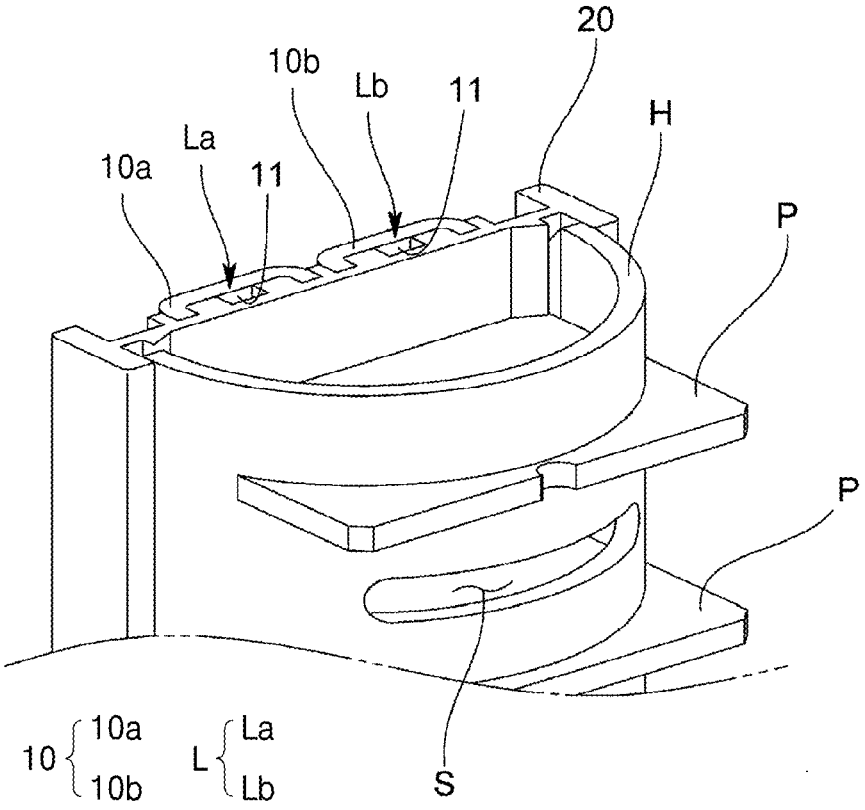
FIG. 4 is a schematic perspective view of a flow path forming member according to an embodiment of the present disclosure.

FIG. 4 is a schematic perspective view of the flow path forming member 10 according to an embodiment of the present disclosure. As shown in FIG. 4, the flow path forming member 10 is combined with the opening forming member 20 to form a distribution flow path L through which the refrigerant is supplied. For example, the combining of the flow path forming member 10 with the opening forming member 20 forms the distribution flow path L through which the refrigerant is supplied. Here, the distribution flow path L is a passage that allows the refrigerant to flow from the bottom to the top. As shown in FIG. 1, the plurality of branch tubes Z1 are connected to the flow path forming member 10. The flow path forming member 10 extends in a direction of arrangement of the small-diameter tubes T (here, the vertical direction), and is combined with the opening forming member 20 to form a space between the opening forming member 20 and the flow path forming member 10 as a distribution flow path L. For example, the combining of the flow path forming member 10 with the opening forming member 20 forms the described space.

For example, as shown in FIG. 4, a concave portion 11 is provided on a side of the flow path forming member 10 opposite to the opening forming member 20. The distribution flow path L is formed by combining the flow path forming member 10 with the opening forming member 20 such that the recess portion 11 is blocked by the opening forming member 20. A shape of the distribution flow path L is not limited to a particular shape, and for example, a cross-sectional shape of the distribution flow path L perpendicular to a direction of flow of the refrigerant may be rectangular, partially circular, or a combination of rectangular and partially circular.

For example, the refrigerant distributor 100 may include at least two independent distribution flow paths L. In an embodiment of the present disclosure, as shown in FIG. 4, two distribution flow paths L that are independent of each other are formed by a pair of flow path forming members 10. Hereinafter, when distinguishing between the flow path forming members 10, one of the pair of flow path forming members 10 is referred to as a first flow path forming member 10*a*, and the other is referred to as a second flow path forming member 10*b*. In some aspects, a distribution flow path L formed by the first flow path forming member 10*a* is referred to as a first distribution flow path La, and a distribution flow path L formed by the second flow path forming member 10*b* is referred to as a second distribution flow path Lb.

Figure 5:
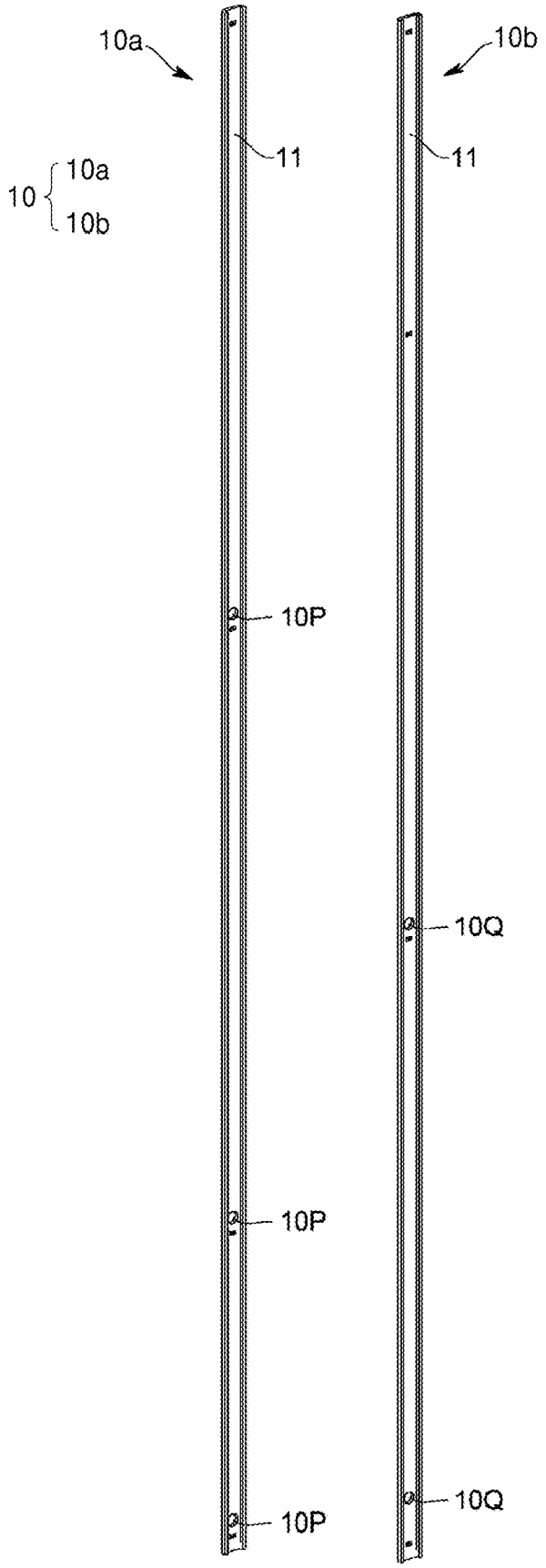
FIG. 5 is a schematic perspective view of a flow path forming member according to an embodiment of the present disclosure.

FIG. 5 is a schematic perspective view of the flow path forming member 10 according to an embodiment of the present disclosure. Referring to FIGS. 4 and 5, the first flow path forming member 10*a* includes a plurality of inlets (first inlets) 10P to which branch tubes Z1 are connected. A refrigerant flowing along the branch tube Z1 enters the first distribution flow path La through the inlet 10P. In the present embodiment, the plurality of inlets 10P are provided, for example, at predetermined intervals along the longitudinal direction (vertical direction) of the first flow path forming member 10*a*. The predetermined interval may be an equidistant interval. The predetermined interval may vary regularly, for example, from the bottom towards the top. For example, the predetermined interval may become progressively longer or shorter from the bottom towards the top.

The second flow path forming member 10*b* includes a plurality of inlets (second inlets) 10Q to which branch tubes Z1 different from the branch tubes Z1 connected to the first flow path forming member 10*a* are connected. A refrigerant flowing along the branch tube Z1 enters the second distribution flow path Lb through the inlet 10Q. In the present embodiment, the plurality of inlets 10Q are provided, for example, at predetermined intervals along the longitudinal direction (vertical direction) of the second flow path forming member 10*b*. Also, the predetermined interval may be an equidistant interval. The predetermined interval may vary regularly, for example, from the bottom towards the top. For example, the predetermined interval may become progressively longer or shorter from the bottom towards the top.

As shown in FIG. 5, the inlet 10P of the first flow path forming member 10*a* and the inlet 10Q of the second flow path forming member 10*b* are provided at different heights in the vertical direction. In other words, the inlet 10P of the first flow path forming member 10*a* and the inlet 10Q of the second flow path forming member 10*b* are arranged in a zigzag shape to be offset relative to each other in the vertical direction. However, one located at a lowest among the inlets 10P of the first flow path forming member 10*a* is provided at the same or almost the same height as one located at a lowest among the inlets 10Q of the second flow path forming member 10*b*.

<Opening Forming Member 20>

Figure 6:
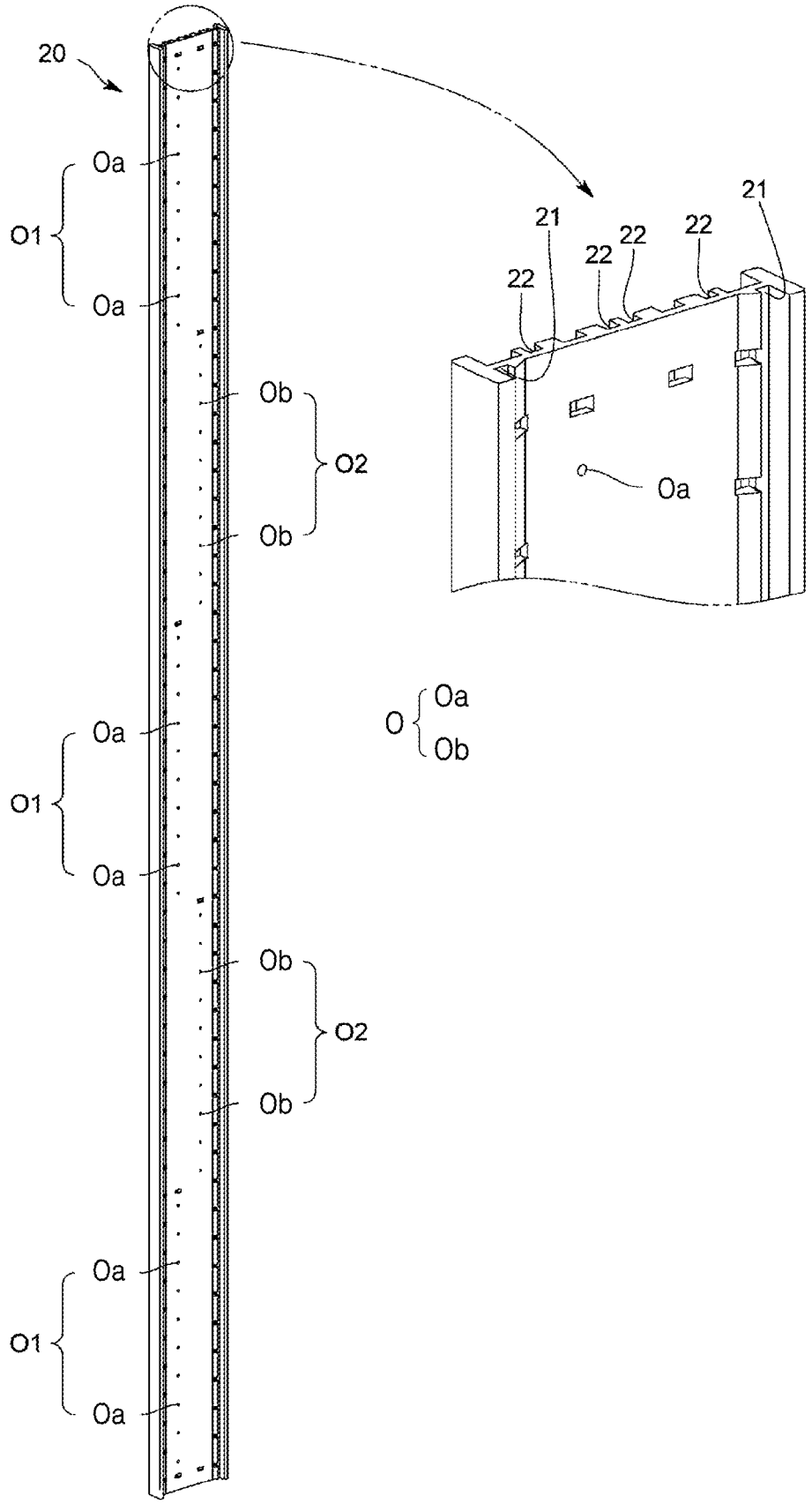
FIG. 6 is a schematic perspective view of an opening forming member according to an embodiment of the present disclosure.

FIG. 6 is a schematic perspective view of the opening forming member 20 according to an embodiment of the present disclosure. Referring to FIGS. 2 and 6, the opening forming member 20 is provided between the header cover H and the flow path forming member 10. The opening forming member 20 is provided with a plurality of openings O via which the distribution flow path L communicates with the partition spaces S. The opening forming member 20 elongate along a direction of arrangement of the small-diameter tubes T (here, the vertical direction).

For example, the opening forming member 20 has a plate shape elongated in the vertical direction, and is provided with a first mounting portion 21 to which the header cover H is coupled, on one side (a first side) of the opening forming member 20, and a second mounting portion 22 to which the flow path forming member 10 is coupled, on another side (a second side) of the opening forming member 20. For example, the first mounting portion 21 has a concave shape (concave portion) in which free ends, which are two ends of the header cover H in a circumferential direction, are received and the second mounting portion 22 has a concave shape (concave portion) in which free ends, which are two ends of the flow path forming member 10 in a width direction, is received. However, the shape of the first mounting portion 21 or the second mounting portion 22 is not limited thereto, and the first mounting portion 21 and the second mounting portion 22 may be of any suitable shape capable of respectively receiving the two ends of the header cover H in the circumferential direction and the two ends of the flow path forming member 10 in the width direction.

The opening forming member 20 of the present embodiment includes a plurality of first openings Oa, which are openings O via which the first distribution flow path La communicates with the partition spaces S, and a plurality of second openings Ob, which are openings O via which the second distribution flow path Lb communicates with the partition spaces S. The plurality of first openings Oa are provided at positions corresponding to the concave portion 11 of the first flow path forming member 10*a*. The plurality of first openings Oa may be grouped into a plurality of first opening groups O1. Each of the plurality of first opening groups O1 may include a plurality of first openings Oa. The plurality of first opening groups O1 are arranged at predetermined intervals along the vertical direction.

A plurality of first openings Oa included in each of the first opening groups O1 may all be of the same size, or at least some of the plurality of first openings Oa may be of different sizes. When the plurality of first openings Oa included in each first opening group O1 are of different sizes, the size of the plurality of first openings Oa may be gradually smaller or larger from the upstream side towards the downstream side (i.e., from the bottom towards the top), and may be changed regularly or irregularly. In some aspects, a first opening Oa located at the most upstream side (i.e., at the lowest) among the plurality of first openings Oa included in each first opening group O1 may be made larger than the other first openings Oa.

With regard to a diameter of the first opening Oa, a ratio of a cross-sectional area of the first opening Oa to a cross-sectional area of the first distribution flow path La may be in a range of at least 2% but not more than 60%, and more preferably, in a range of at least 5% but not more than 40%. In some aspects, when at least some of the plurality of first openings Oa have different diameters, it is desirable that a ratio of an average cross-sectional area of the plurality of first openings Oa to the cross-sectional area of the first distribution flow path La is in a range of at least 10% but not more than 30%. Accordingly, for example, embodiments of the present disclosure support implementations in which a ratio of an average cross-sectional area of the plurality of first openings Oa to the cross-sectional area of the first distribution flow path La is in a range of at least 10% but not more than 30%. The terms "a range of at least X % but not more than Y %" and "a range of X % to Y %" may be used interchangeably herein.

With such a cross-sectional area ratio, a sufficient pressure loss may be imposed on the refrigerant flowing from the first distribution flow path La to the first opening Oa, and the pressure loss in the first distribution flow path La and the first opening Oa may be properly balanced (e.g., according to a target pressure loss or target pressure balance). For example, aspects of the cross-sectional area ratio support imposing a pressure loss on the refrigerant flowing from the first distribution flow path La to the first opening Oa, in which the imposed pressure loss results in a balancing of the pressure loss in the first distribution flow path La and the first opening Oa.

A second opening Ob is provided at a position away from a first opening Oa in a width direction of the opening forming member 20. The plurality of second openings Ob may be grouped into a plurality of second opening groups O2. Each of the plurality of second opening groups O2 may include a plurality of second openings Ob. The plurality of second opening groups O2 are arranged at predetermined intervals along the vertical direction.

A plurality of second openings Ob included in each of the second opening groups O2 may all be of the same size, or at least some of the plurality of second openings Ob may be of different sizes. When the plurality of second openings Ob included in each second opening group O2 are of different sizes, the size of the plurality of second openings Ob may be gradually smaller or larger from the upstream side towards the downstream side (i.e., from the bottom towards the top), and may be changed regularly or irregularly. In some aspects, a second opening Ob located at the most upstream side (i.e., at the lowest) among the plurality of second openings Ob included in each second opening group O2 may be made larger than the other second openings Ob.

With regard to a diameter of the second opening Ob, a ratio of a cross-sectional area of the second opening Ob to a cross-sectional area of the second distribution flow path Lb may be in a range of at least 2% but not more than 60%, and more preferably, in a range of at least 5% but not more than 40%. In some aspects, when at least some of the plurality of second openings Ob have different diameters, it is desirable that a ratio of an average cross-sectional area of the plurality of second openings Ob to the cross-sectional area of the second distribution flow path Lb is in a range of at least 10% but not more than 30%. Accordingly, for example, embodiments of the present disclosure support implementations in which at least some of the plurality of second openings Ob have different diameters, and in which a ratio of an average cross-sectional area of the plurality of second openings Ob to the cross-sectional area of the second distribution flow path Lb is in a range of at least 10% but not more than 30%.

With such a cross-sectional area ratio, a sufficient pressure loss may be imposed on the refrigerant flowing from the second distribution flow path Lb to the second opening Ob, and the pressure loss between the second distribution flow path Lb and the second opening Ob may be properly balanced (e.g., according to a target pressure loss or target pressure balance). For example, aspects of the cross-sectional area ratio support imposing a pressure loss on the refrigerant flowing from the second distribution flow path Lb to the second opening Ob, in which the imposed pressure loss results in a balancing of the pressure loss between the second distribution flow path Lb and the second opening Ob.

A first opening group O1 and a second opening group O2 may be arranged at different heights, as shown in FIG. 6. In other words, the first opening group O1 and the second opening group O2 may be arranged in a zigzag shape to be offset relative to each other in the vertical direction. That is, the second opening group O2 may be located between two adjacent first opening groups O1, and the first opening group O1 may be located between two adjacent second opening groups O2.

Figure 7:
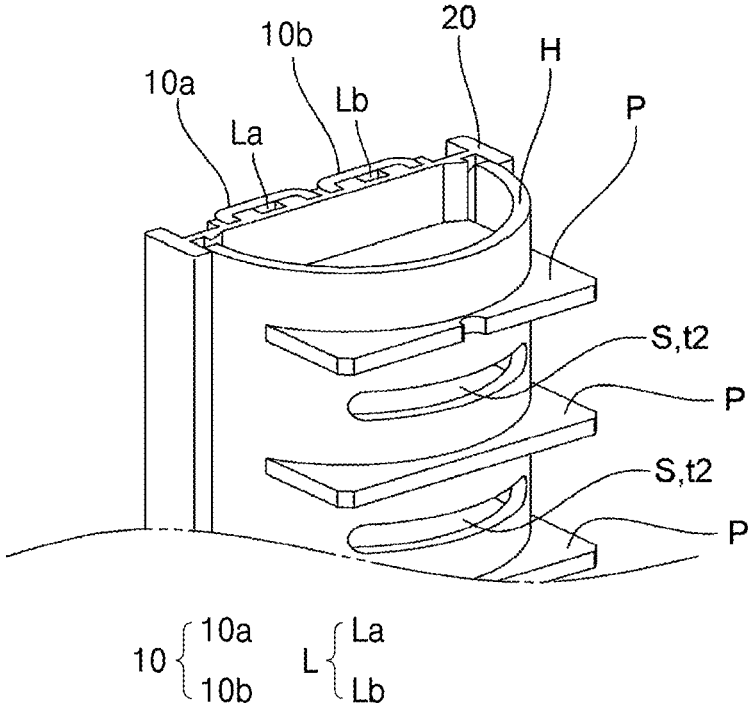
FIG. 7 is a schematic perspective view and a plan view of a refrigerant distributor according to an embodiment of the present disclosure.
Figure 7:
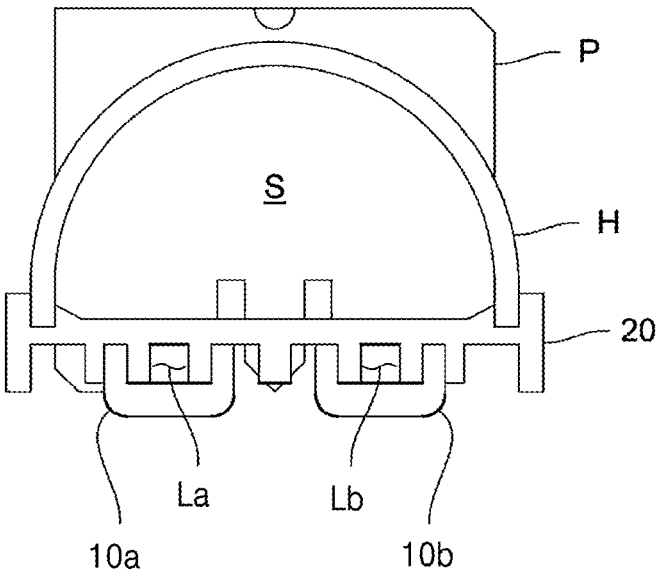

FIG. 7 is a schematic perspective view and a plan view of the refrigerant distributor 100 according to an embodiment of the present disclosure. (A) and (B) of FIG. 7 are respectively a perspective view and a plan view of the header cover H, the flow path forming member 10, and the opening forming member 20 in a combined state. Referring to FIG. 7, the header cover H is mounted to one side (a first side) of the opening forming member 20, and the plurality of partition plates P are inserted into the first slits t1 of the header cover H to form the plurality of partition spaces S. For example, the insertion of the plurality of partition plates P into the first slits t1 of the header cover H forms the plurality of partition spaces S. By mounting a pair of flow path forming members 10, i.e., the first and second flow path forming members 10*a* and 10*b*, to another side (a second side) of the opening forming member 20, the two independent distribution flow paths La and Lb are formed.

Figure 8:
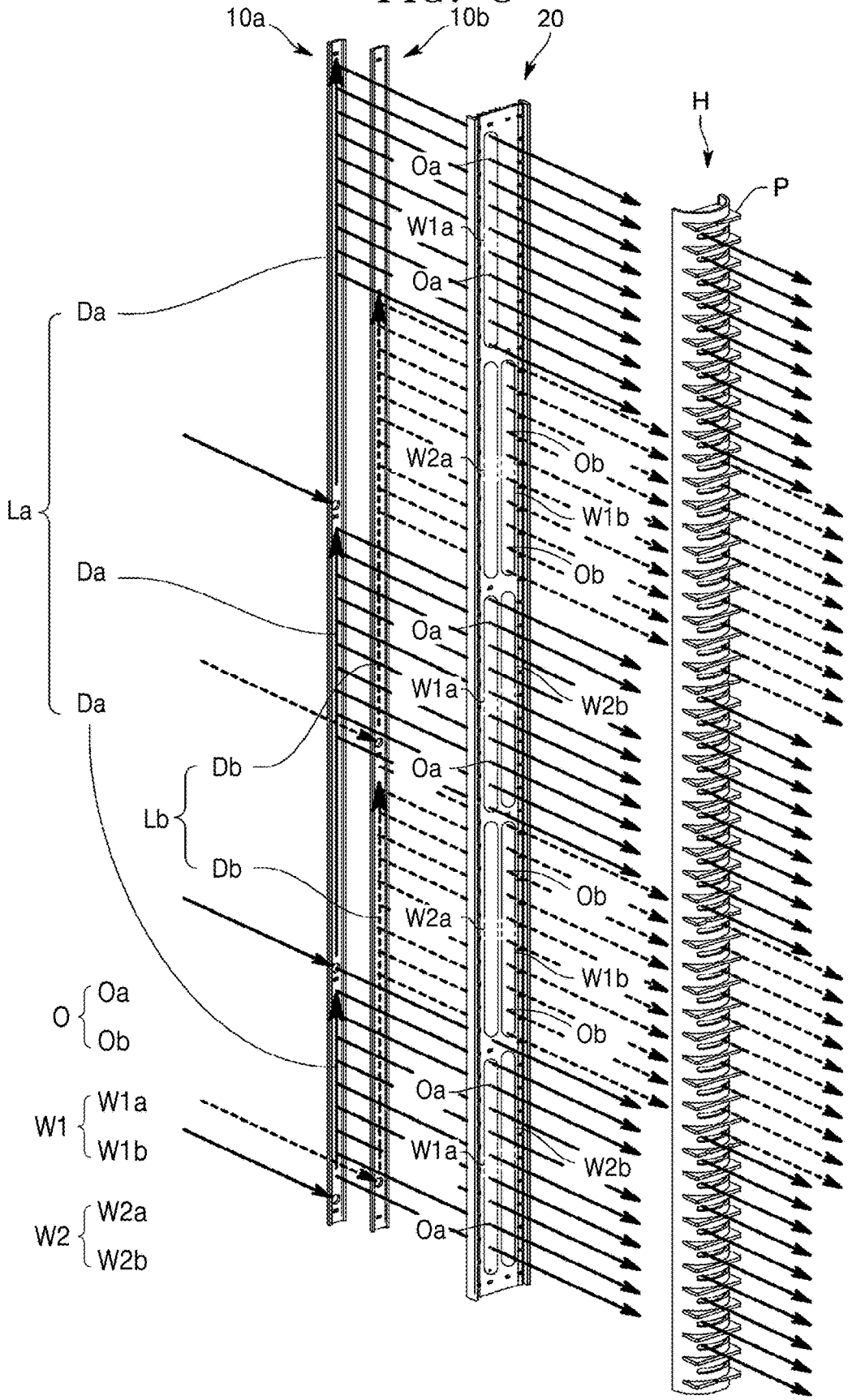
FIG. 8 is a perspective view showing a distribution flow path according to an embodiment of the present disclosure.

FIG. 8 is a perspective view showing the distribution flow path L according to an embodiment of the present disclosure. For convenience of description, FIG. 8 illustrates the distribution flow path L in a state in which the header cover H, the flow path forming member 10, and the opening forming member 20 are separated from one another. Referring to FIG. 8, the refrigerant distributor 100 is configured such that a distribution flow path L among the first and second distribution flow paths La and Lb, i.e., the first distribution flow path La, supplies refrigerant to a predetermined number of partition spaces S, and the other distribution flow path L, i.e., the second distribution flow path Lb, supplies refrigerant not to the predetermined number of partition spaces S but to other partition spaces S next to the predetermined number of partition spaces.

More specifically, the opening forming member 20 is provided with a hole region W1 in which openings O are formed in a line, as shown in FIG. 8, and a development region (or biasing region) W2 that is located on an upstream side of the hole region W1 and biases the flow of refrigerant toward the openings O.

The development region W2 is a region in which the openings O are not formed, or in other words, a region provided between adjacent hole regions W1. A length of the development region W2 is preferably at least 10 times a hydraulic diameter of the distribution flow path L, and more preferably at least 20 times the hydraulic diameter.

The length of the development region W2 is a separation distance from the inlets 10P and 10Q to an opening O located at the most upstream side (i.e., the lowest side) among the plurality of openings O that serve as a passage through which a refrigerant entering the distribution flow path L through the inlets 10P and 10Q flows out of the distribution flow path L. More specifically, the length of the development region W2 is a separation distance from a center of the inlets 10P and 10Q to a center of an opening O located on the most upstream side (i.e., the lowest side) with respect to the inlets 10P and 10Q.

Figure 9:
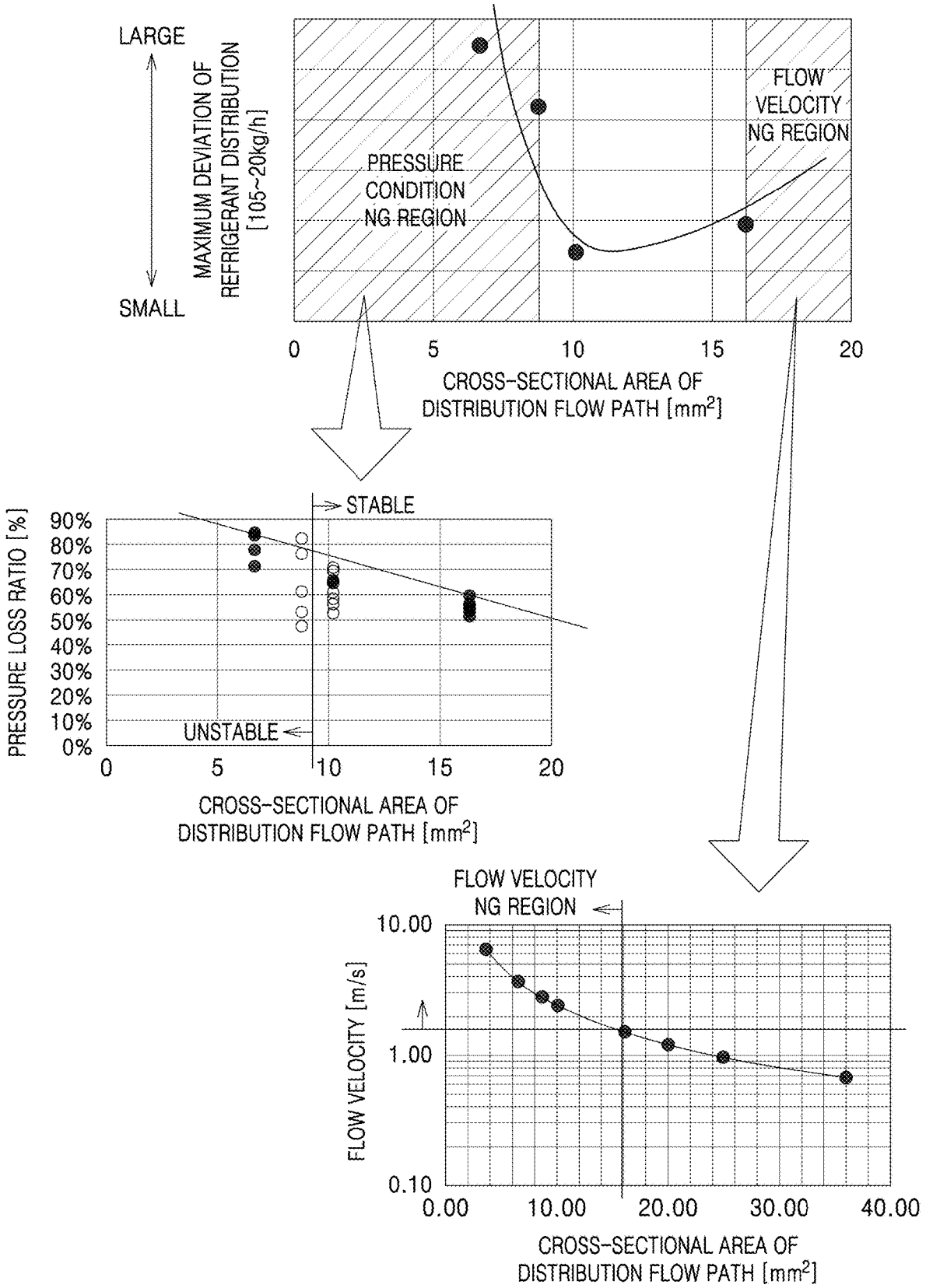
FIG. 9 is a set of graphs illustrating experimental data regarding a cross-sectional area of a distribution flow path, according to an embodiment of the present disclosure.

FIG. 9 is a set of graphs illustrating experimental data regarding a cross-sectional area of the distribution flow path L, according to an embodiment of the present disclosure. Referring to FIG. 9, a cross-sectional area of the distribution flow path L is preferably at least 8 $mm^2$ but not more than 16 $mm^2$. This is because, if the cross-sectional area of the distribution flow path L exceeds 16 $mm^2$, vapor-liquid separation may occur when a flow velocity of the refrigerant is low, resulting in deterioration of refrigerant distribution characteristics, and if the cross-sectional area of the distribution flow path L is less than 8 $mm^2$, pressure loss may become too large when the flow velocity of the refrigerant is high, resulting in deterioration of the refrigerant distribution characteristics due to pressure fluctuations.

When the cross-sectional area of the distribution flow path L is at least 8 $mm^2$ but not more than 16 $mm^2$ as described above, the length of the development range W2 is preferably at least 1 mm but not more than 100 mm, and more preferably at least 5 mm but not more than 100 mm. Embodiments of the present disclosure include setting the length of the development region W2 in the described ranges (e.g., at least 1 mm but not more than 100 mm, at least 5 mm but not more than 100 mm), which prevents too much refrigerant (e.g., an amount of refrigerant exceeding a threshold amount) from flowing through an opening O located on the most upstream side with respect to the inlets 10P and 10Q. In some aspects, setting the length of the development region W2 in the described ranges (e.g., at least 1 mm but not more than 100 mm, at least 5 mm but not more than 100 mm) in accordance with one or more embodiments of the present disclosure supports obtaining a stable distribution ratio regardless of the amount of refrigerant flowing into the distribution flow path L through the inlets 10P and 10Q.

According to an embodiment of the present disclosure, because the plurality of first openings Oa and the plurality of second openings Ob are each arranged in a line, a hole region W1 in which the plurality of first openings Oa are formed in a line is set as a first hole region W1*a*, and a development region W2 between two adjacent first hole regions W1*a* is set as a first development region W2*a*, as shown in FIG. 8. In some aspects, a hole region W1 in which the plurality of second openings Ob are formed in a line is set as a second hole region W1*b*, and a development region W2 between two adjacent second hole regions W1*b* is set as a second development region W2*b*. Also, the first development region W2*a* and the second development region W2*b* are arranged at different heights. In other words, the first development region W2*a* and the second development section W2*b* are arranged in a zigzag shape such that positions of the first development region W2*a* and the second development section W2*b* in the vertical direction are offset relative to each other. A length of the first development region W2*a* may be equal to or different from a length of the second development region W2*b*. In some aspects, a plurality of first development regions W2*a* may all be of equal length, or at least some of the plurality of first development regions W2*a* may be of different lengths. Similarly, a plurality of second development regions W2*b* may all be of equal length, or at least some of the plurality of first development regions W2*a* may be of different lengths.

As shown in FIG. 8, the distribution flow path L according to an embodiment of the present disclosure is divided into a plurality of division areas D, and each of the plurality of division areas D includes a hole region W1 and a development region W2 corresponding to the hole region W1. For example, the first distribution flow path La has a plurality of first division areas Da, and the second distribution flow path Lb has a plurality of second division areas Db. Each of the plurality of first division areas Da includes one hole region W1*a* and a development region W2*a* corresponding to the hole region W1*a*. Each of the plurality of second division areas Db includes one hole region W2*a* and a development region W2*b* corresponding to the hole region W2*a*. Each of the plurality of division areas D communicates with one inlet 10P or 10Q. In other words, each of the plurality of division areas D is provided to correspond to one branch tube Z1. With this configuration, a refrigerant introduced into a corresponding division area D from the branch tube Z1 flows through the division area D from the bottom to the top, and is then supplied to the plurality of partition spaces S through the plurality of openings O formed in the opening forming member 20. In the refrigerant distributor 100 according to an embodiment of the present disclosure, the distribution flow path L may be divided into a plurality of division areas D by the partition plates P forming the plurality of partition spaces S. For example, as shown in FIG. 8, the partition plates P divide the first distribution flow path La into the plurality of first division areas Da, and the second distribution flow path Lb into the plurality of second division areas Db. The partition plates P divide each of the upstream and downstream sides of the first distribution flow path La and the second distribution flow path Lb into division areas by partially blocking the distribution flow path L, and for example, the partition plate P includes a closure portion (P1 of FIG. 10) inserted into the distribution flow path L to block the distribution flow path L.

Figure 10:
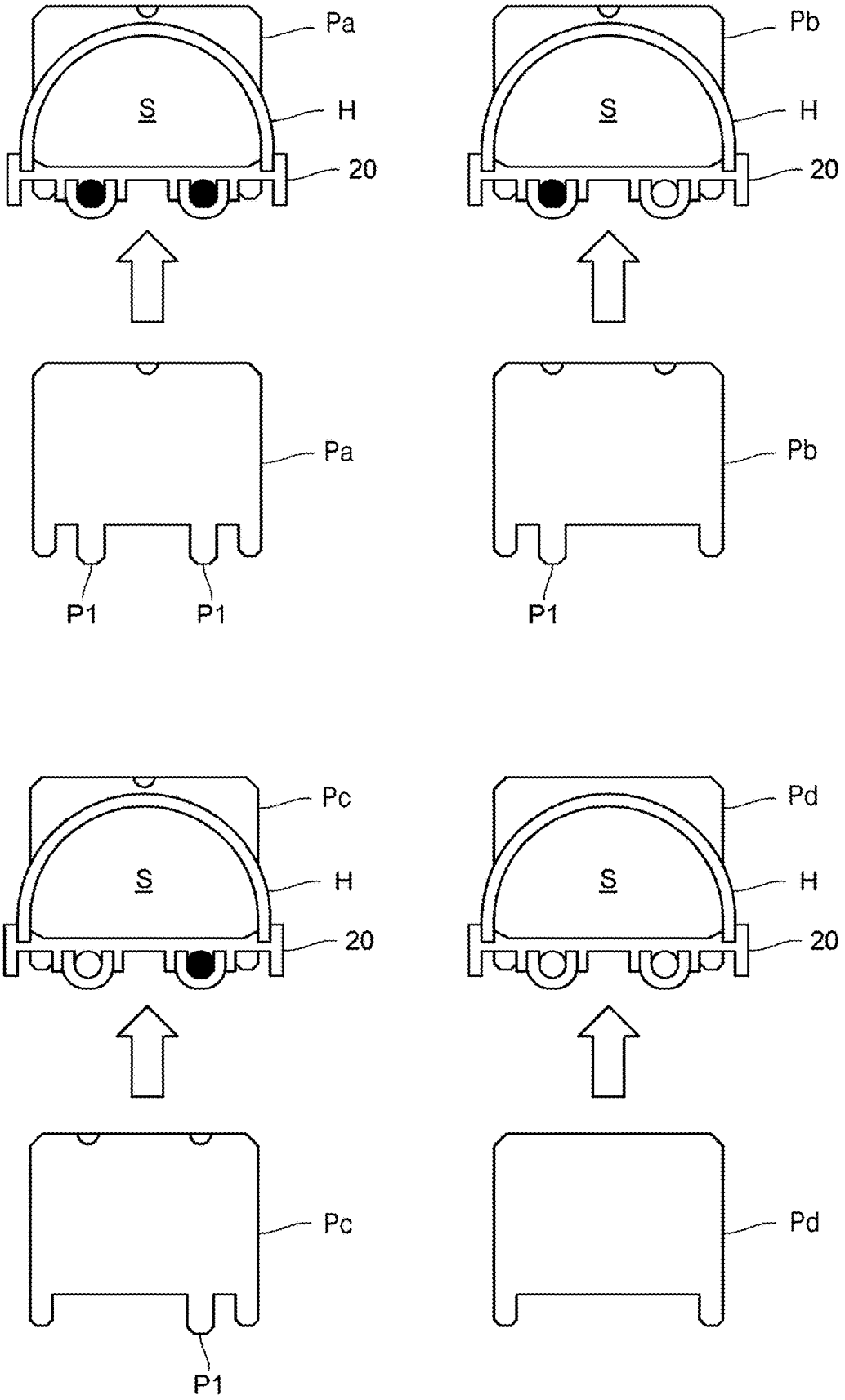
FIG. 10 is plan views illustrating various examples of a partition plate according to an embodiment of the present disclosure.

There may be various examples of partition plates P blocking the distribution flow path L. FIG. 10 is plan views illustrating various examples of partition plates P according to an embodiment of the present disclosure. Referring to FIG. 10, a first partition plate Pa blocking both the first distribution flow path La and the second distribution flow path Lb, a second partition plate Pb blocking the first distribution flow path La and opening the second distribution flow path Lb, a third partition plate Pc opening the first distribution flow path La and blocking the second distribution flow path Lb, and a fourth partition plate Pd opening both the first distribution flow path La and the second distribution flow path Lb may be utilized. Here, the second partition plate Pb, which divides the first distribution flow path La into a plurality of first division areas Da, and the third partition plate Pc, which divides the second distribution flow path Lb into a plurality of second division areas Db, are inverted with respect to each other. That is, the second partition plate Pb and the third partition plate Pc are axially symmetrical to each other, in other words, have a mirror-image symmetrical shape.

According to the refrigerant distributor 100 configured as described above, one of the two distribution flow paths L supplies refrigerant to a predetermined number of partition spaces S, and the other distribution flow path L supplies refrigerant to a predetermined number of other partition spaces S next to the predetermined number of partition spaces S. Thus, a development region W2 may be formed in each of the two distribution flow paths L. By providing the development region W2 in the described manner, it is possible to reduce or prevent the drift (uneven distribution) of vapor-liquid refrigerant, which occurs when the supply of the refrigerant is concentrated in some of the plurality of small-diameter tubes T. Accordingly, for example, embodiments of the present disclosure include providing the development region W2 as described herein, which may reduce or prevent the drift (uneven distribution) of vapor-liquid refrigerant. In some aspects, because the flow of vapor-liquid refrigerant is stabilized, the refrigerant may be distributed to a small-diameter tube T in an appropriate amount, and furthermore, the refrigerant supplied to each of the plurality of small-diameter tubes T may be distributed in appropriate amounts.

If the development region W2 as described herein in accordance with one or more embodiments of the present disclosure is not provided, it is difficult for most of the liquid refrigerant in the vapor-liquid refrigerant to reach upper partition spaces S among the plurality of partition spaces S, and such liquid refrigerant flows into relatively lower partition spaces S, thereby causing a drift of refrigerant. In contrast, by providing the development region W2 as in the refrigerant distributor 100 according to an embodiment of the present disclosure, the flow of the vapor-liquid refrigerant is diverted upward by the development region W2, and an upward inertial force is applied to the liquid refrigerant. As a result, the liquid refrigerant flows into the lower partition spaces S and also into the upper partition spaces S, which may consequently reduce or prevent a drift of the refrigerant.

Furthermore, by appropriately setting a size of openings O formed in each hole region W1, the amount of the refrigerant supplied to each small-diameter tube T may be varied, for example, depending on a wind speed distribution, or the refrigerant may be evenly distributed to each small-diameter tube T. Furthermore, because the plurality of partition plates P, which divide the header cover H into the plurality of partition spaces S, also partition the distribution flow path L into the plurality of division areas D, the partition plates P may be used as a divider of the partition spaces S as well as a partition between the division areas D, thereby reducing the number of parts. In some aspects, the partition plate Pb, which divides the first distribution flow path La into a plurality of first division areas Da, and the partition plate Pc, which divides the second distribution flow path Lb into a plurality of second division areas Db, are inverted with respect to each other, i.e., axially symmetrical to each other, thereby further reducing the number of parts.

Figure 11:
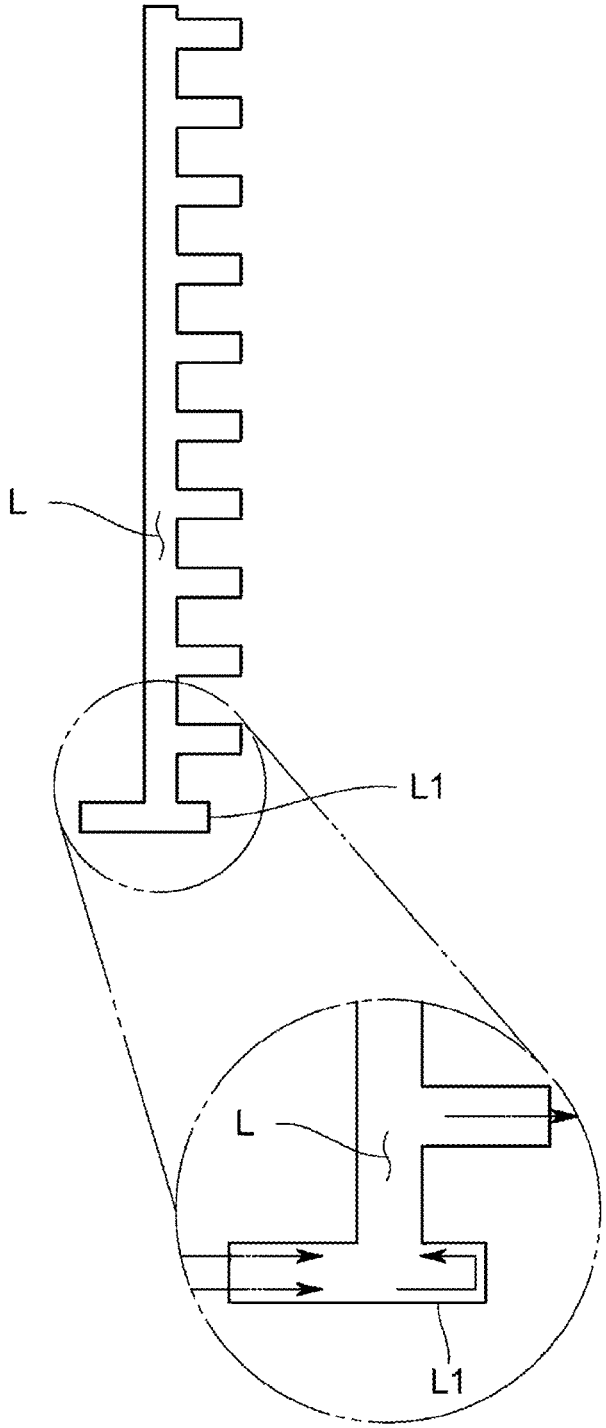
FIG. 11 illustrates a distribution flow path according to an embodiment of the present disclosure.

Additionally, the refrigerant distributor 100 according to the present disclosure is not limited to the above-described embodiments. FIG. 11 illustrates a distribution flow path L according to an embodiment of the present disclosure. For example, referring to FIG. 11, the distribution flow path L may have a concave portion L1 against which a refrigerant flowing from the branch tube Z1 collides before flowing upward. For example, the concave portion L1 may extend from the distribution flow path L in the same direction as a direction of the refrigerant flowing into the distribution flow path L. Accordingly, an upward inertial force acting on the refrigerant flowing from the branch tube Z1 may be reduced by the refrigerant returning after hitting the concave portion L1. In some aspects, here, the concave portion L1 is formed for the branch tube Z1 connected to a lowermost end of the flow path forming member 10, but the concave portion L1 may be formed for any other branch tube Z1. In this case, a length of a development region W2 may be shorter than the length described in the above-described embodiments.

Figure 12:
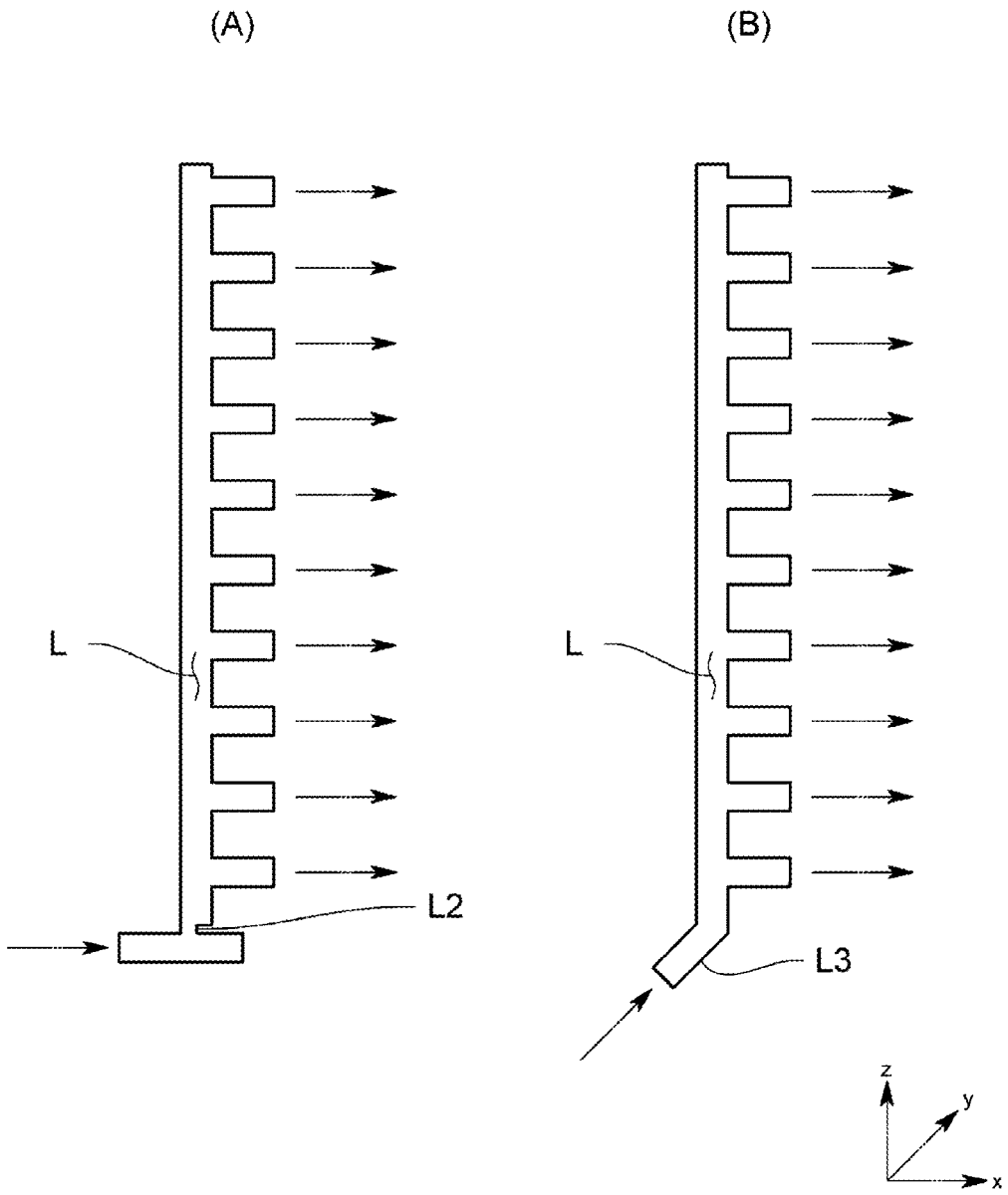
FIG. 12 shows examples of a distribution flow path according to an embodiment of the present disclosure.

FIG. 12 shows examples of a distribution flow path L according to an embodiment of the present disclosure. Referring to (A) of FIG. 12, the distribution flow path L may be provided with a tapering portion L2 where a width of the flow path is narrowed. The tapering portion L2 may be in a form that partially narrows a width of an upward flow path of the distribution flow path L This may prevent too much refrigerant from flowing into a small-diameter tube T located close to the tapering portion L2. Here, the tapering portion L2 is formed for a branch tube Z1 connected to a lower end of the flow path forming member 10, but the tapering portion L2 may be formed for any other branch tube Z1. In that case, a length of the development region W2 may be shorter than the length described in the above-described embodiments.

As shown in (B) of FIG. 12, the distribution flow path L may have an inclined portion L3 such that an inflow direction in which refrigerant flows from a branch tube Z1 intersects an outflow direction in which the refrigerant flows out into a partition space S. This facilitates flowing of a pre-designed amount of refrigerant in the outflow direction, regardless of magnitude of an inertial force in the inflow direction of the refrigerant. In some aspects, here, the inclined portion L3 is provided for the branch tube Z1 connected to the lower end of the flow path forming member 10, but the inclined portion L3 may be formed for any other branch tube Z1. In that case, a length of the development region W2 may be shorter than the length described in the above-described embodiments.

In the above-described embodiments, two distribution flow paths L are formed by a pair of flow path forming members 10, but three or more distribution flow paths L may be formed by using three or more flow path forming members 10.

Figure 13:
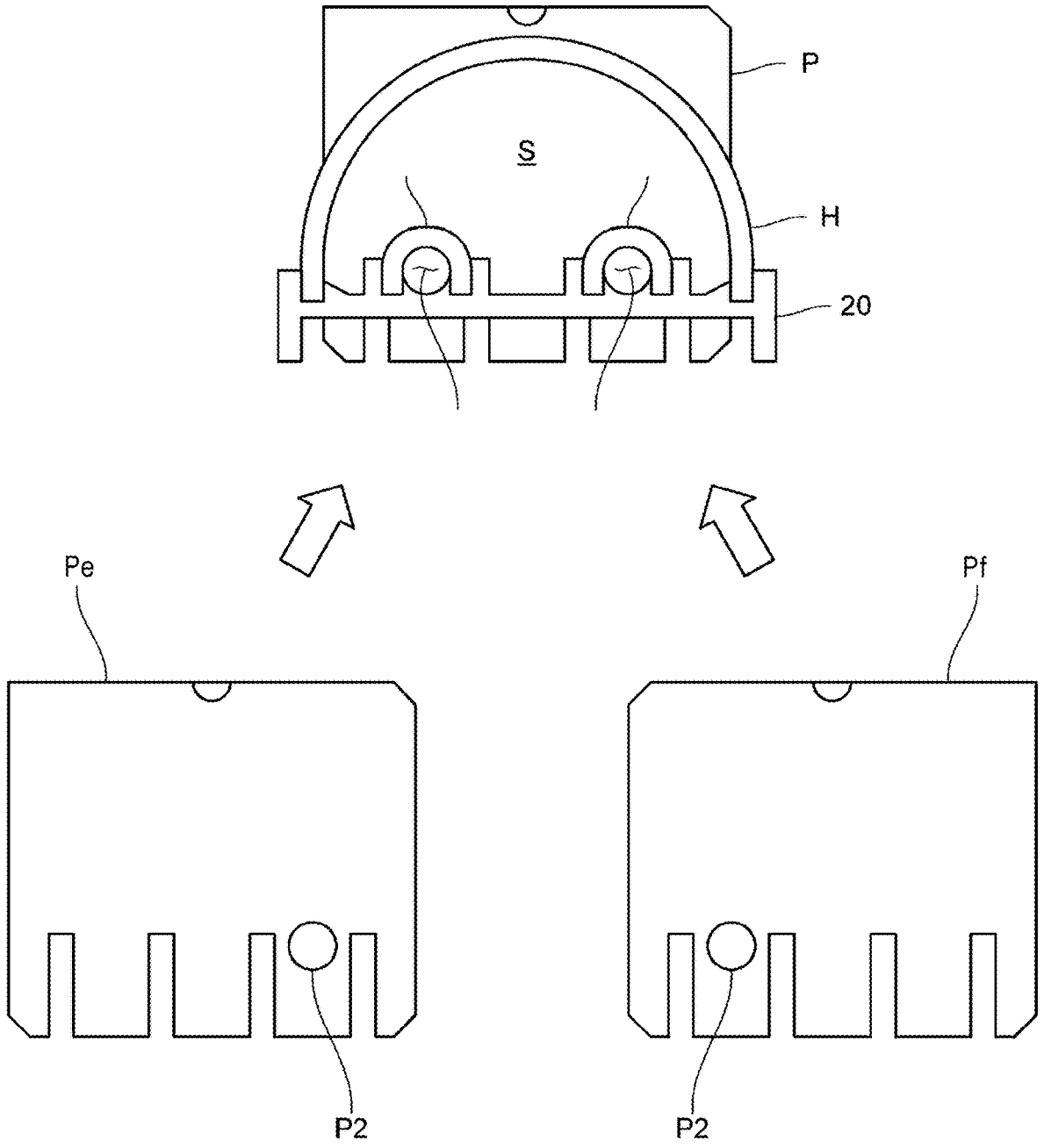
FIG. 13 is a schematic plan view of a refrigerant distributor according to an embodiment of the present disclosure.

In the above-described embodiments, the opening forming member 20 is provided between the header cover H and the flow path forming member 10, but a positional relationship among the opening forming member 20, the header cover H, and the flow path forming member 10 is not limited to the above-described embodiments. FIG. 13 is a schematic plan view of the refrigerant distributor 100 according to an embodiment of the present disclosure. Referring to FIG. 13, both the header cover H and the flow path forming member 10 may be coupled to one side (e.g., the first side) of the opening forming member 20. In this case, by using partition plates Pe and Pf each having a flow path hole P2 communicating with one of the two distribution flow paths L (e.g., without communicating to the other of the two distribution flow paths L), as shown in FIG. 13, the distribution flow path L may be divided using a partition plate P forming a partition space S. The partition plates Pe and Pf may be inverted with respect to each other, i.e. axially symmetrical to each other. Therefore, the partition plate Pe and the partition plate Pf may be substantially the same. The term "substantially the same," as used herein, means approximately or actually the same (e.g., within a threshold difference amount).

An air conditioner according to an aspect of the present disclosure includes an outdoor air heat exchanger performing heat exchange between outside air and a refrigerant, and an indoor air heat exchanger performing heat exchange between inside air and the refrigerant. At least one of the outdoor air heat exchanger and the indoor air heat exchanger includes a main tube, at least two distribution flow paths that are independent of each other, to which a plurality of branch tubes branched from the main tube are connected, a header cover H divided into a plurality of partition spaces S receiving refrigerant from the at least two distribution flow paths, and a plurality of heat exchange tubes T connected to the plurality of partition spaces, and a distribution flow path La among the at least two distribution flow paths supplies refrigerant to a predetermined number of partition spaces among the plurality of partition spaces, and another distribution flow path Lb among the at least two distribution flow paths does not supply refrigerant to the predetermined number of partition spaces but supplies the refrigerant to partition spaces at positions different from positions of the predetermined number of partition spaces among the plurality of partition spaces. According to this configuration, one of the two distribution flow paths supplies the refrigerant to the predetermined number of partition spaces, and the other distribution flow path supplies the refrigerant to a predetermined number of other partition spaces next to the predetermined number of partition spaces. Thus, a development region may be formed in each of the two distribution flow paths. By providing the development region, the drift of vapor-liquid refrigerant may be reduced or prevented, and the flow of vapor-liquid refrigerant is stabilized such that refrigerant supplied to each of the plurality of heat exchange tubes may be distributed in an appropriate amount.

In an embodiment, the air conditioner may include an opening forming member having a hole region in which a plurality of openings are formed that allow communication between each of the at least two distribution flow paths and the partition spaces. The air conditioner may include a development region located upstream of the hole region and having no openings formed therein. The development region may bias the flow of refrigerant toward the plurality of openings in the hole region along each of the at least two distribution flow paths. This may reduce or prevent drift of the vapor-liquid refrigerant, and by appropriately setting a size of the openings, the amount of the refrigerant supplied to each heat exchange tube may be varied, for example, depending on a wind speed distribution, or the refrigerant may be evenly distributed to each heat exchange tube.

In an embodiment, at least some of the plurality of openings may be of different sizes. In an embodiment, an opening located at the most upstream side among the plurality of openings included in the hole region may be larger than the other openings. This allows the refrigerant to be distributed to the plurality of heat exchange tubes in an appropriate amount.

In an embodiment, a ratio of a diameter of the plurality of openings to a cross-sectional area of each of the at least two distribution flow paths may be in a range of at least 2% but not more than 60%. As a result, a sufficient pressure loss may be imposed on the refrigerant flowing from a distribution flow path to an opening, and pressure loss in the distribution flow path and the opening may be properly balanced (e.g., according to a target pressure loss or target pressure balance). For example, aspects of the ratio of the diameter of the plurality of openings to the cross-sectional area of each of the at least two distribution flow paths as described herein support imposing a pressure loss on the refrigerant flowing from a distribution flow path to an opening, in which the imposed pressure loss results in a balancing of the pressure loss in the distribution flow path and the opening. In some aspects, the refrigerant supplied to each of the heat exchange tubes arranged side by side in upper and lower multiple stages may be controlled to be distributed in appropriate amounts according to the wind speed distribution, and furthermore, heat exchange performance may be improved.

In an embodiment, a length of the development region may be at least 10 times a hydraulic diameter of each of the at least two distribution flow paths. As a result, drift of the refrigerant may be more easily reduced or prevented. For example, the length of the development region in accordance with one or more embodiments of the present disclosure described herein support a reduction or prevention of drift of the refrigerant.

In an embodiment, the at least two distribution flow paths allow the refrigerant to flow from the bottom to the top. In an embodiment, each of the at least two distribution flow paths is divided into a plurality of division areas, and refrigerant introduced into the plurality of division areas may be supplied to the plurality of partition spaces. In an embodiment, each of the plurality of division areas may include a hole region communicating with corresponding partition spaces via a plurality of openings and a development region corresponding to the hole region and where the plurality of openings are not formed. Each of the plurality of division areas may be connected to one branch tube, and thus, the refrigerant introduced into each of the division areas may be uniformly supplied to the corresponding partition spaces.

In an embodiment, the air conditioner includes a plurality of partition plates that divide the header cover into the plurality of partition spaces, and each of the at least two distribution flow paths may be divided into the plurality of division areas by some of the plurality of partition plates. Therefore, the partition plates may be used as a divider of the partition spaces as well as a partition between the division areas, thereby reducing the number of parts.

In an embodiment, two partition plates dividing each of the at least two distribution flow paths into a plurality of division areas may be axially symmetrical to each other. Thus, by reversing a partition plate, the partition plate may be adapted to form division areas on both sides, i.e., a distribution flow path and the other distribution flow path, thereby further reducing the number of parts.

In an embodiment, at least one of the at least two distribution flow paths may include a concave portion extending in the same direction as an inflow direction of refrigerant such that the incoming refrigerant collides against the concave portion before flowing upward. As a result, an inertial force acting on the refrigerant entering the distribution flow path may be canceled out as the refrigerant returns after hitting the concave portion.

In an embodiment, at least one of the at least two distribution flow paths may include a tapering portion where a width of the flow path is narrowed. This may prevent too much refrigerant from flowing into a heat exchange tube located close to the tapering portion.

In an embodiment, at least one of the at least two distribution flow paths may include an inclined portion such that an inflow direction in which refrigerant is introduced intersects an outflow direction in which the refrigerant flows out into the partition spaces. This may facilitate flowing of a pre-designed amount of refrigerant in the outflow direction regardless of magnitude of an inertial force in the inflow direction of the refrigerant.

The air conditioner according to the above-described embodiments is capable of distributing the refrigerant supplied to each of the plurality of heat exchange tubes in appropriate amounts.

Although embodiments have been described above by way of limited examples and the drawings, various modifications and variations may be made by one of ordinary skill in the art from the above description.

The invention claimed is:

1. An air conditioner comprising:

an outdoor air heat exchanger configured to perform heat exchange between outside air and a refrigerant; and an indoor air heat exchanger configured to perform heat exchange between inside air and the refrigerant, wherein at least one of the outdoor air heat exchanger and the indoor air heat exchanger comprises:

a main tube;

at least two distribution flow paths that are independent of each other, to which a plurality of branch tubes branched from the main tube are connected;

a header cover divided into a plurality of partition spaces receiving the refrigerant from the at least two distribution flow paths;

a plurality of heat exchange tubes connected to the plurality of partition spaces; and an opening forming member formed to include:

a hole region in which a plurality of openings that allow each of the at least two distribution flow paths to communicate with the partition spaces are formed, wherein the plurality of openings are arranged along a longitudinal direction of the opening forming member; and a development region located upstream of the hole region along the longitudinal direction of the opening forming member and in which the openings are not formed, wherein:

a distribution flow path among the at least two distribution flow paths is configured to supply the refrigerant to a predetermined number of partition spaces among the plurality of partition spaces, and another distribution flow path among the at least two distribution flow paths is configured to supply the refrigerant to partition spaces at positions different from positions of the predetermined number of partition spaces among the plurality of partition spaces without supplying the refrigerant to the predetermined number of partition spaces.

2. The air conditioner of claim 1, wherein:

the opening forming member is formed to further include a second hole region in which a second plurality of openings that allow each of the at least two distribution flow paths to communicate with the partition spaces are formed, wherein the second plurality of openings are arranged along the longitudinal direction of the opening forming member, and the development region is located between the hole region and the second hole region along the longitudinal direction of the opening forming member.

3. The air conditioner of claim 1, wherein the development region is configured to bias a flow of the refrigerant toward the plurality of openings in the hole region along each of the at least two distribution flow paths.

4. The air conditioner of claim 1, wherein at least some of the plurality of openings are of different sizes.

5. The air conditioner of claim 1, wherein a length of the development region is at least 10 times a hydraulic diameter of each of the at least two distribution flow paths.

6. The air conditioner of claim 1, wherein an opening located at a most upstream side among the plurality of openings included in the hole region is larger than other openings among the plurality of openings.

7. The air conditioner of claim 1, wherein a ratio of a diameter of an opening of the plurality of openings to a cross-sectional area of each of the at least two distribution flow paths is in a range of 2% to 60%.

8. The air conditioner of claim 1, wherein the at least two distribution flow paths are configured to allow the refrigerant to flow from bottom to top.

9. The air conditioner of claim 1, wherein each of the at least two distribution flow paths is divided into a plurality of division areas, and the refrigerant introduced into the plurality of division areas is supplied to the plurality of partition spaces.

10. The air conditioner of claim 9, wherein each of the plurality of division areas comprises:

a hole region configured to communicate with the partition spaces via a plurality of openings formed in the hole region; and a development region corresponding to the hole region and in which the openings are not formed, and each of the plurality of division areas is connected to one branch tube.

11. The air conditioner of claim 9, further comprising:

a plurality of partition plates configured to divide the header cover into the plurality of partition spaces, wherein each of the at least two distribution flow paths is divided into the plurality of division areas by some of the plurality of partition plates.

12. The air conditioner of claim 11, wherein two partition plates configured to divide each of the at least two distribution flow paths into the plurality of division areas are axially symmetrical to each other.

13. The air conditioner of claim 1, wherein at least one of the at least two distribution flow paths comprises a concave portion extending in a same direction as an inflow direction of the refrigerant such that incoming refrigerant collides against the concave portion before flowing upward.

14. The air conditioner of claim 1, wherein the at least one of the at least two distribution flow paths comprises a tapering portion where a width of the flow path is narrowed.

15. The air conditioner of claim 1, wherein the at least one of the at least two distribution flow paths comprises an inclined portion such that an inflow direction in which the refrigerant is introduced intersects an outflow direction in which the refrigerant flows out into the partition spaces.

16. An air conditioner comprising:

an outdoor air heat exchanger configured to perform heat exchange between outside air and a refrigerant; and wherein the outdoor air heat exchanger comprises:

a main tube;

at least two distribution flow paths that are independent of each other, to which a plurality of branch tubes branched from the main tube are connected;

a header cover divided into a plurality of partition spaces receiving the refrigerant from the at least two distribution flow paths;

a plurality of heat exchange tubes connected to the plurality of partition spaces; and an opening forming member formed to include:

a hole region in which a plurality of openings that allow each of the at least two distribution flow paths to communicate with the partition spaces are formed, wherein the plurality of openings are arranged along a longitudinal direction of the opening forming member; and a development region located upstream of the hole region along the longitudinal direction of the opening forming member and in which the openings are not formed, wherein:

a distribution flow path among the at least two distribution flow paths is configured to supply the refrigerant to a predetermined number of partition spaces among the plurality of partition spaces, and another distribution flow path among the at least two distribution flow paths is configured to supply the refrigerant to partition spaces at positions different from positions of the predetermined number of partition spaces among the plurality of partition spaces without supplying the refrigerant to the predetermined number of partition spaces.

17. The air conditioner of claim 16, wherein:

the opening forming member is formed to further include a second hole region in which a second plurality of openings that allow each of the at least two distribution flow paths to communicate with the partition spaces are formed, wherein the second plurality of openings are arranged along the longitudinal direction of the opening forming member, and the development region is located between the hole region and the second hole region along the longitudinal direction of the opening forming member.

18. The air conditioner of claim 16, wherein the development region is configured to bias a flow of the refrigerant toward the plurality of openings in the hole region along each of the at least two distribution flow paths.

19. An air conditioner comprising:

an indoor air heat exchanger configured to perform heat exchange between inside air and a refrigerant, wherein the indoor air heat exchanger comprises:

a main tube;

at least two distribution flow paths that are independent of each other, to which a plurality of branch tubes branched from the main tube are connected;

a header cover divided into a plurality of partition spaces receiving the refrigerant from the at least two distribution flow paths; and a plurality of heat exchange tubes connected to the plurality of partition spaces; and an opening forming member formed to include:

a hole region in which a plurality of openings that allow each of the at least two distribution flow paths to communicate with the partition spaces are formed, wherein the plurality of openings are arranged along a longitudinal direction of the opening forming member; and a development region located upstream of the hole region along the longitudinal direction of the opening forming member and in which the openings are not formed, wherein:

a distribution flow path among the at least two distribution flow paths is configured to supply the refrigerant to a predetermined number of partition spaces among the plurality of partition spaces, and another distribution flow path among the at least two distribution flow paths is configured to supply the refrigerant to partition spaces at positions different from positions of the predetermined number of partition spaces among the plurality of partition spaces without supplying the refrigerant to the predetermined number of partition spaces.

20. The air conditioner of claim 19, wherein:

the opening forming member is formed to further include a second hole region in which a second plurality of openings that allow each of the at least two distribution flow paths to communicate with the partition spaces are formed, wherein the second plurality of openings are arranged along the longitudinal direction of the opening forming member, and the development region is located between the hole region and the second hole region along the longitudinal direction of the opening forming member.

* * * * *